US005593042A

United States Patent [19]

Keller

[11] Patent Number: 5,593,042

[45] Date of Patent: Jan. 14, 1997

[54] QUALITY-CONTROL SIEVE AND METHOD OF USING IT

[75] Inventor: Alois Keller, Uzwil, Switzerland

[73] Assignee: Bühler AG, Switzerland

[21] Appl. No.: 335,732

[22] PCT Filed: Mar. 11, 1994

[86] PCT No.: PCT/CH94/00053

§ 371 Date: Mar. 1, 1995

§ 102(e) Date: Mar. 1, 1995

[87] PCT Pub. No.: WO94/20228

PCT Pub. Date: Sep. 15, 1994

[30] Foreign Application Priority Data

Mar. 12, 1993 [DE] Germany ..... 43 07 789.7

[51] Int. Cl.[6] ..... B07B 1/18

[52] U.S. Cl. ..... 209/261; 209/262; 209/285; 209/296; 209/300; 209/389

[58] Field of Search ..... 209/284, 285, 209/296, 299, 300, 385, 389, 241, 247, 250, 255, 257, 261, 262

[56] References Cited

U.S. PATENT DOCUMENTS

| | | | |
|---|---|---|---|
| 1,443,773 | 1/1923 | Wadsworth | 209/261 X |
| 2,389,715 | 11/1945 | Beardsley | 209/284 X |
| 2,667,905 | 2/1954 | Tanner | 209/284 X |
| 3,928,188 | 12/1975 | Link et al. . | |
| 4,880,539 | 11/1989 | Crawford et al. | 209/289 X |

*Primary Examiner*—David H. Bollinger
*Attorney, Agent, or Firm*—Finnegan, Henderson, Farabow, Garrett & Dunner, L.L.P.

[57] ABSTRACT

The novel invention proposes a final screen which is very reliable in operation and which is suitable more particularly also for building into a pneumatic conveying line. In a first section the material is distributed uniformly over the entire peripheral surface of the screen shell. The subsequent section is used for completing screening and separating the coarse material out through an outlet. A centrifuging rotor with helically arranged elastomeric cleaning lobes projecting from the centrifuging bars provide a high throughput and particularly damage-obviating discharge of even relatively large foreign bodies.

15 Claims, 2 Drawing Sheets

QUALITY-CONTROL SIEVE AND METHOD OF USING IT

TECHNOLOGICAL FIELD

The invention relates to a final screen especially with a pneumatic material feed system, a screen housing, a cylindrical screen shell with a centrifuging rotor rotating therein, an outlet for the screen oversize, and an outlet for the screenings or screen throughs.

BACKGROUND ART

Apart from when breakdowns occur, millers nowadays produce finished products whose purity, as regards foreign substances content, is almost absolute. The product passes through a large number of screening stages already when the ground material is being produced. Unexpectedly, however, check screening operations at the customers can disclose a troublesome foreign content or awkward foreign constituents. Therefore, this requires a further final screening before the further processing of materials of the flour or semolina type. This kind of entry-stage final screen at the premises of a consumer of foodstuffs or animal feed, or of food mill products, has to meet very specific requirements. Basically, out of relatively large delivery quantities, for example 8,000 kg of flour per hour, perhaps only a few grams of impurities have to be screened out. The final screening is to be particularly reliable before further processing is begun. It is often necessary to choose a situation for the screening machine on the way along the conveying line. The final screen can be arranged within a for example already existing pneumatic conveying line, but then there is a requirement to construct the screen suitably to obviate having considerable resistance, which would increase the power required for pneumatic conveyance. A characteristic category has developed here of the so-called "screening machine in the pneumatic conveyance line", emanating from the proposal in the old German patent specification No. 867 193. This old publication proposed arranging a beater device with a high rotational speed within a cylindrical screen shell, and effecting the further conveyance of the flour freed from husks through an annular cylindrical duct with the air flow. However, the emphasis of that apparatus is on functioning as a bran centrifuge, which is a typical apparatus in process technology in milling. In DE-OS No. 2 121 726 the said apparatus was further developed as regards the actual function of final screening of large quantities of flour which for example have to be transferred from a transport vehicle into silos. The proposal is put forward to situate the screen apparatus at the end of a pneumatic conveying conduit. Instead of the traditional beater device in bran centrifuges a rotor provided with longitudinal blades is selected, and the material for screening is conducted through a disc against the screen shell.

In a further development of the final screen apparatus according to DE-OS No. 2 338 909 it is proposed to employ unilateral mounting for the rotor, which throws the material outwards. The feeding pneumatic conveying conduit can be extended in the axial direction from the machine side opposite from the drive to beyond the middle of the screen cylinder interior space. Disadvantages which result here are unfavourable flow conditions for the material-air mixture, and a concept which as far as machine construction is concerned is suitable only for relatively small apparatus, owing to the unilateral mounting. Access to the screen is made difficult.

SUMMARY OF THE INVENTION

The invention has had as its object to obviate the disadvantages of the known solutions, and more particularly to achieve a considerable throughput with the greatest possible safety for the final screening. In the case of using pneumatic conveyance only a low pressure loss is to occur.

The solution according to the invention is characterised in that the centrifuging rotor has a plurality of centrifuging bars extending substantially over the entire length of the screen shell and having radially projecting conveying or cleaning lobes which are made preferably of elastomeric material and operate in the vicinity of the screen shell or lightly contact the internal surface of the screen shell.

The invention permits quite a number of particularly advantageous constructional forms. Experience in the state of the art assumed that the best screening effect can be maintained over the long term by arranging on the centrifuging bars brush elements which are effective over the entire internal screen surface, so that the screen is continually brushed to some extent. A screen opening is deliberately chosen through which all the flour can pass. But precisely because of the relative large screen openings, fatigued bristles (D<0.3 mm) from the brush cleaning element can pass through and get undesirably e.g. into the foodstuff. An optimum screening effect was obtained when the centrifuging bars have a plurality of radially projecting elastomeric conveying or cleaning lobes. With the elastic conveying or cleaning lobes, corresponding bristle fragments no longer occur. On the contrary, tests have shown that any such which were already in the material are in fact sorted out of the material. It is also proposed that the cleaning lobes are arranged with longitudinal spacing from one another on the same centrifuging bar, with a preferably offset arrangement relatively to the next centrifuging bar in succession, to form a helical conveying component over the length of the screen shell. Because of the twisting or spinning kind of motion thus produced in the material the screening operation is promoted and at the same time rapid conveyance of oversize material and controlled discharging of foreign substances to the outlet are ensured. For example in the case of flour or semolina type products the elastic cleaning lobes contact the internal surface (working surface) of the screen shell and keep this clean. Hard oversize constituents such as screws, pins or the like cannot jam between beater bars and screen shell owing to the elastic construction and a preferably trapezoidal configuration. As soon as the frictional force increases slightly the lobe becomes deformed and allows the item to pass. As a result, no relatively great friction (heat) occurs at the screen. Careful discharge becomes possible, so that no damage to the screen occurs. Tests were carried out with many varied unwanted articles or substances (oversize items) under very extreme conditions. Neither air nor product were led into the machine, only the foreign items. No damage occurred as a result either to the screen meshes or to the foreign items.

However, the expected output or performance was also obtainable with pneumatic material feeding, and a low pressure loss of the order of 30 to 50 mm WG (water column) could be determined. Tests confirmed that the material for screening is not simply conducted into the interior space of the screen cylinder, but at the same time can be distributed in an optimum manner already within a first section of the screen shell by an entry or infeed distributor. The preponderant proportion of the flour passes through the screen shell already in the first third, provided that the centrifuging bars are already fully active in this section. The infeed distributor is constructed as a driven infeed centrifuging-action worm, and can be an infeed worm with one thread but preferably two or more threads. If the infeed distributor in fact works in the manner of a scattering plate, the worm housing can be constructed to be rotatable, with an entry stub pipe for the pneumatic material feed system, this pipe opening tangentially or radially relatively to the axis of rotation of the centrifuging rotor. With a large number of possible arrangements as regards the position and direction of the pneumatic conveying conduit, this allows the connection to any location on the periphery to be of simple construction, with the smallest possible number of conduit bends. When using purely mechanical infeed the connection can be chosen freely at least within a top angle of 90°. Through the mechanically constrainedly uniform distribution by the infeed distributor, the special direction of the material feed system no longer has any influence on the product arrival at the screen. It has been found that the rotor can be driven with a low rotational speed, preferably at less than 500 r.p.m. As a result the service life of the final screen apparatus, more particularly the life of the screen shell and the cleaning lobes, can be prolonged. A further displacement element can be situated between the distribution section and the outlet for the screen oversize, the outlet being formed as an annular gap for the screen oversize preferably by means of an elastomeric disc. But it is also possible for the centrifuging rotor to have between the distribution section and the outlet a stepped or conically widening displacement element or at least 2 corresponding baffle discs.

The invention also relates to a method for the final screening of flour-type materials more particularly with pneumatic conveyance, with a cylindrical screen shell, a centrifuging rotor rotating therein, and a screen housing, coarse constituents being separated off as screen oversize through an outlet, and is characterised in that the centrifuging rotor has over the length of the screen shell yieldable, preferably elastomeric, radially projecting cleaning lobes with a helical conveying effect, and the outlet for the screen oversize is formed by an elastically yieldable disc in such a manner that even relatively large foreign matter is discharged without damage with the coarse constituents.

The invention will now be described with further details with reference to some constructional examples.

DESCRIPTION OF THE PREFERRED EMBODIMENT

Figure 1:
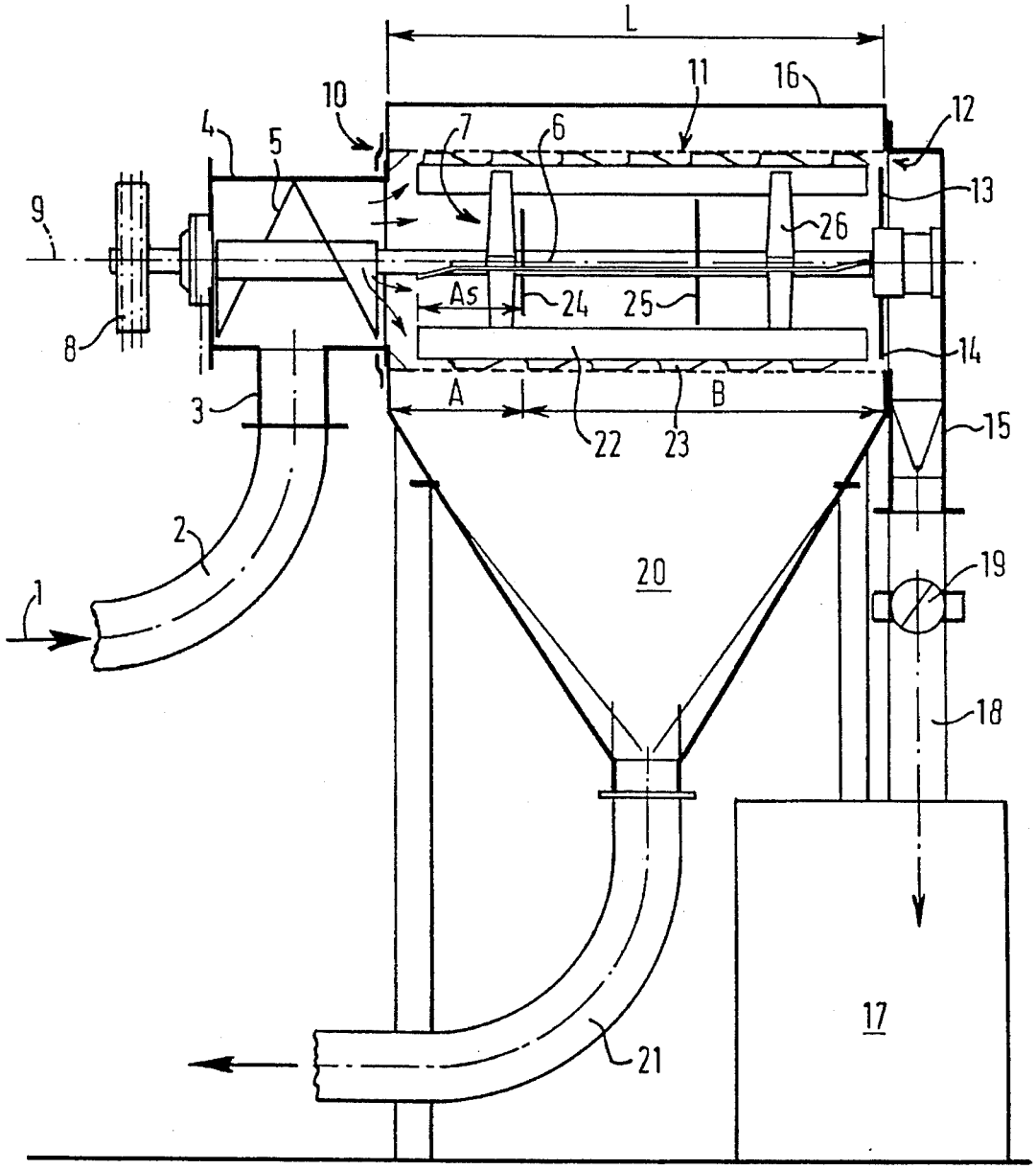
FIG. 1 shows a final screen in cross-section.

FIG. 1 will now be considered in what follows. A pneumatic material feed system 1 is connected via an elbow piece 2 to a stub pipe 3 of a rotatable worm housing 4 of an infeed worm 5. The infeed worm 5 is connected securely to a shaft 6 of a centrifuging rotor 7 adapted to be driven by means of a belt pulley 8. The housing 4 can be rotated about the axis 9 of the centrifuging rotor 7 and situated in any desired rotational-angle position, for example screwed by means of clamping rings 10 to a machine housing 16. The centrifuging rotor 7 is surrounded over its entire length by a screen shell 11, so that the cleaned material can only pass through the meshes of the screen shell 11. Relatively coarse items or constituents which must be screened out are removed at the opposite end through an outlet 12. The outlet 12 is defined by the screen shell 11 and an elastomeric disc 13 which has a somewhat smaller diameter than the screen shell 11 and forms a gap 14. A coarse-material box 15 is preferably capable of being swung away about a vertical axis, for monitoring the screen shell and for servicing. The machine housing 16 and a collecting container 17 and feed duct 18 and closure valve 19 are of pressure-resistant construction in accordance with requirements. The lower portion of the machine housing is constructed as a collecting hopper 20 on which there is arranged a conveying tube 21 in the event of pneumatic conveying-onwards of the screen throughs.

The centrifuging rotor 7 has four centrifuging bars 22 extending substantially over the entire length L of the screen shell 11, these being situated offset by 90° in each case. The centrifuging bars have as a primary function to keep the material in a strong rotating motion, so that the corresponding centrifugal force drives the material always towards the screen shell 11. There are also arranged on the centrifuging rotor 7 two baffle discs 24 and 25 which are intended to prevent a too direct longitudinal movement of the material. At the same time the two baffle discs 24 and 25 divide the interior screen space into three portions, a first section A amounting to preferably less than ⅓ of the length and the remaining section B correspondingly more than ⅔ of the length. The section A at the same time forms the distribution section, in which through the rotating movement of the infeed worm 5 the material is uniformly distributed over the entire periphery of the screen shell 11. An additional distributing effect is achieved in that the centrifuging bars 22 extend over this section also to an extent "As". The centrifuging bars 22 are connected rigidly to the shaft 6 by a spider 26. Mounted securely on the centrifuging bars 22 are a large number of conveying or cleaning lobes 23 which project radially, are more or less elastomeric and lightly contact the screen shell 11 for all nonabrasive materials.

Figure 3:
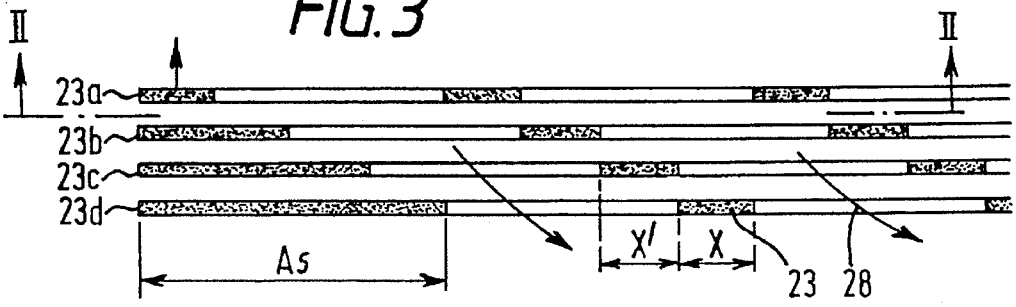
FIG. 3 shows a view III of FIG. 2.
Figure 2:
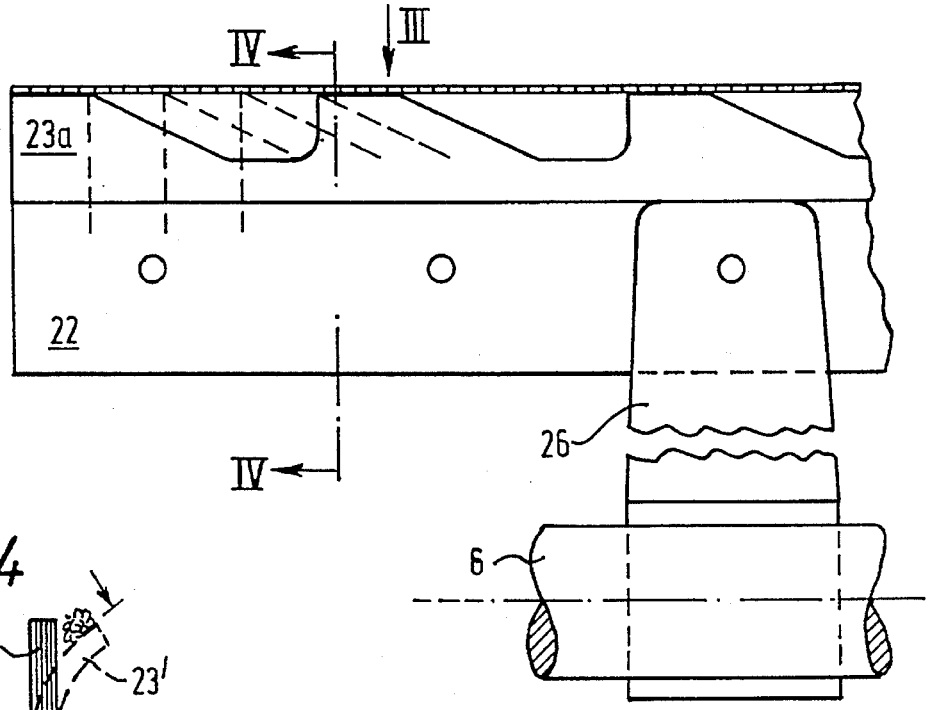
FIG. 2 shows diagrammatically the arrangement of cleaning lobes with 4 centrifuging bars shown directly behind one another.
Figure 4:
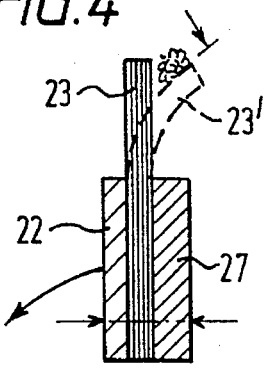
FIG. 4 shows a section view IV—IV of FIG. 2 on a larger scale.

The cleaning lobes 23 are shown on a larger scale in FIGS. 2, 3 and 4. The conveying or cleaning lobes 23, as is shown in FIG. 4, are secured by a clamping strip 27 on the centrifuging bars 22, and can bend over rearwards (23') when a large foreign body enters, so that the latter does not jam fast as may happen with rigid bars or strips. FIG. 3 shows diagrammatically the four centrifuging bars 22 in a closely adjacent sequence. The conveying or cleaning lobes are staggered by an amount X, and in the example the amount X also corresponds approximately to the length of an individual cleaning lobe 23. Preferably the individual cleaning lobe will be given a trapezoidal form, so that over the entire length of an individual centrifuging bar 22 a sawtooth formation is produced (FIG. 2). The staggered arrangement effects a conveying effect as is indicated with the arrows 28 (FIG. 3). Thus a twisting or spinning effect is produced in the interior space of the screen shell, especially for the coarse material, towards the outlet, to the end of the screen shell. It is particularly important that the centrifuging bars 22 and the cleaning lobes 23 are fully effective in the distribution section A also. Therefore, in this region it is desirable, by giving the cleaning lobes **23*a*, 23*b*, 23*c* and 23*d*** lengths unlike one another, without staggering, to have only a minimal conveying effect but an intensive distributing and screening-promoting effect.

Figure 5:
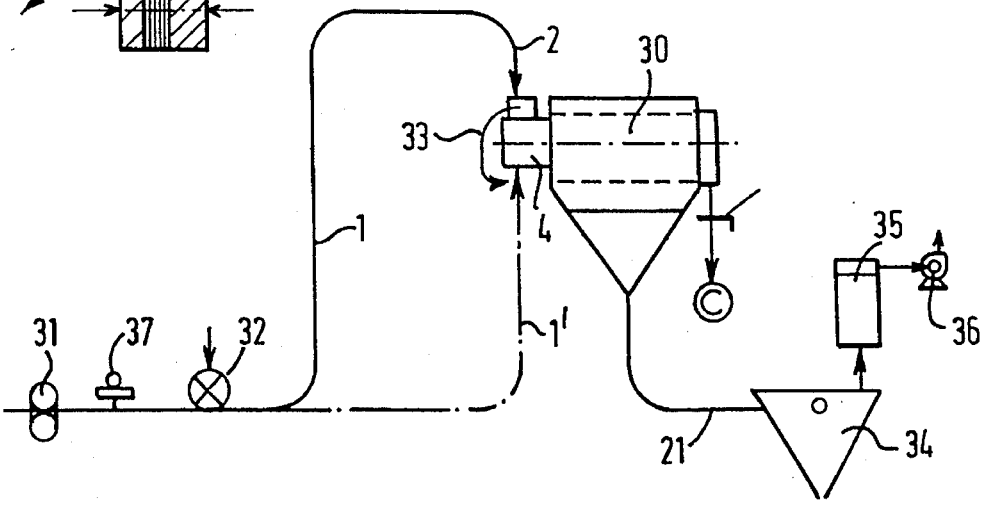
FIG. 5 is a diagrammatic view of a pneumatic pressure conveyor installation with final screening.

FIG. 5 shows an example of a pneumatic pressure conveyor installation with a built-in final screen 30. A fan 31 delivers the necessary compressed air the pressure of which is adjustable by means of a pressure regulating valve 37. The material is fed into the pressure conveying conduit 1 by way of a rotary air lock 32. A dot-dash line also indicates that the conveying conduit may also be given a course as indicated by the line 1', which can be brought about by rotating the worm housing 4 in the arrow 33 direction. The pneumatic tube 21 for the screened material is conveyed with the same conveying air into a hopper 34 or for example into a container from which the air is discharged through a filter 35 and a fan 36, and the material can be fed onwards to further processing.

I claim:

1. A screen apparatus to be used in a pneumatic material feed system comprising:

a screen housing having an inlet;

a cylindrical screen shell disposed within the screen housing; and a centrifuging rotor rotatably positioned within the cylindrical screen shell, the centrifuging rotor rotating about an axis and having a plurality of centrifuging bars extending along a substantial portion of the cylindrical screen shell, the centrifuging bars having a plurality of radially projecting conveying and cleaning lobes, the lobes being disposed in the vicinity of the screen shell and having a longitudinal spacing relative to one another along the same centrifuging bar and offset relative to the lobes on an adjacent centrifuging bar to helically move the material through the apparatus.

2. The screen apparatus of claim 1, wherein the lobes lightly contact the screen shell.

3. The screen apparatus of claim 1, wherein the cylindrical shell is sized to allow cleaned material to pass radially through the screen shell and keep unwanted, coarse materials inside the shell.

4. The screen apparatus of claim 1 further comprising a rotatable worm housing at the housing inlet, the rotatable worm housing having a material feed inlet and a worm screw connected to the centrifuging rotor for moving the material from the material feed inlet through the housing inlet and into the apparatus.

5. The screen apparatus of claim 4 wherein the material feed inlet has an axis arranged tangentially or radially to an axis of the centrifuging rotor.

6. The screen apparatus of claim 1 further including a distribution section in a first third of the screen shell and the centrifuging rotor including a worm screw ,attached thereto at an entry of the screen shell for distribution of the material to the screen shell.

7. The screen apparatus of claim 6 further comprising a rotating baffle disc attached to the centrifuging rotor to define the distribution section.

8. The screen apparatus of claim 1, the screen housing including a collecting hopper disposed under the screen shell to collect cleaned materials.

9. The screen apparatus of claim 8, the apparatus further comprising an outlet, the outlet comprising a gap between the screen shell and a disc positioned at an end of the centrifuging rotor opposite the inlet for removing the unwanted, coarse materials.

10. The screen apparatus of claim 1 wherein the feed system is a pressurized system and the screen apparatus is sealed and causes a minimal pressure loss in the system.

11. The screen apparatus of claim 10 where in the minimal pressure loss is about 30 to 50 mm WG.

12. A screen apparatus to be used in a pneumatic material feed system comprising:

a screen housing having an inlet;

a cylindrical screen shell disposed within the screen housing;

a centrifuging rotor rotatably positioned within the cylindrical screen shell, the centrifuging rotor rotating about an axis and having a plurality of centrifuging bars, the centrifuging bars having a plurality of radially projecting conveying and cleaning lobes, the lobes having a longitudinal spacing relative to one another along the same centrifuging bar and offset relative to the lobes on an adjacent centrifuging bar to helically move the material through the apparatus.

13. A screen apparatus to be used in a pneumatic material feed system comprising:

a screen housing having an inlet;

a cylindrical screen shell disposed within the screen housing, the screen being sized to allow cleaned materials to pass therethrough and to keep unwanted, coarse materials inside the shell;

a centrifuging rotor rotatably positioned within the cylindrical screen shell, the centrifuging rotor rotating about an axis and having a plurality of centrifuging bars extending along a substantial portion of the cylindrical screen shell, the centrifuging bars having a plurality of radially projecting conveying and cleaning lobes, the lobes being disposed in the vicinity of the screen shell.

14. A method for screening materials in a pneumatic conveyance system comprising the steps of:

feeding material into an inlet in a housing, the housing having a cylindrical screening shell and a centrifuging rotor rotatably positioned within the cylindrical screening shell, the centrifuging rotor having a plurality of centrifuging bars extending along a substantial portion of the cylindrical screen shell, the centrifuging bars having a plurality of radially projecting conveying and cleaning lobes, the lobes operating in the vicinity of the screen shell and having a longitudinal spacing relative to one another along the same centrifuging bar and offset relative to the lobes on an adjacent centrifuging bar;

rotating the centrifuging rotor about an axis, the rotating step including the steps of:

distributing the material in a distribution section with a worm screw; and imparting helical movement to the material with the plurality of radially projecting conveying and cleaning lobes;

removing the cleaned materials passing through the screen shell in a collecting hopper disposed under the screen shell; and removing unwanted coarse materials at an outlet in the apparatus.

15. A screen apparatus to be used in a pneumatic material feed system comprising:

a screen housing having an inlet;

a cylindrical screen shell disposed within the screen housing;

a centrifuging rotor rotatably positioned within the cylindrical screen shell, the centrifuging rotor rotating about an axis and having a plurality of centrifuging bars extending along a substantial portion of the cylindrical screen shell, the centrifuging bars having a plurality of radially projecting conveying and cleaning lobes, the lobes being disposed in the vicinity of the screen shell and being made of elastomeric material; and an outlet, the outlet comprising a gap between the screen shell and a disc positioned at an end of the centrifuging rotor opposite the inlet for removing unwanted, coarse materials, wherein the screen housing further includes a collecting hopper disposed under the screen shell to collect cleaned material passing through the screen shell.

* * * * *

UNITED STATES PATENT AND TRADEMARK OFFICE

CERTIFICATE OF CORRECTION

PATENT NO. : 5,593,042

DATED : January 14, 1997

INVENTOR(S) : Alois KELLER

It is certified that error appears in the above-indentified patent and that said Letters Patent is hereby corrected as shown below:

Claim 6, Col. 5, L. 49, replace "screw ,attached" with --screw attached--.

Signed and Sealed this

Twenty-fifth Day of March, 1997

*Attest:*

*Attesting Officer*

Bruce Lehman

BRUCE LEHMAN

*Commissioner of Patents and Trademarks*